US010338492B2

(12) United States Patent
Suzuki

(10) Patent No.: US 10,338,492 B2
(45) Date of Patent: Jul. 2, 2019

(54) IMAGE FORMING APPARATUS HAVING ELECTROSTATIC CAPACITY DETECTION

(71) Applicant: CANON KABUSHIKI KAISHA, Tokyo (JP)

(72) Inventor: Hideaki Suzuki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 38 days.

(21) Appl. No.: 15/465,955

(22) Filed: Mar. 22, 2017

(65) Prior Publication Data

US 2017/0277069 A1 Sep. 28, 2017

(30) Foreign Application Priority Data

Mar. 24, 2016 (JP) ..... 2016-060907

(51) Int. Cl.
*G03G 15/06* (2006.01)
*G03G 15/09* (2006.01)
*G03G 15/08* (2006.01)

(52) U.S. Cl.
CPC ..... *G03G 15/065* (2013.01); *G03G 15/0849* (2013.01); *G03G 15/0907* (2013.01); *G03G 2215/0888* (2013.01)

(58) Field of Classification Search
CPC .. G03G 15/09; G03G 15/065; G03G 15/0824; G03G 15/0831; G03G 15/0849; G03G 15/0856; G03G 15/0907; G03G 2215/0888
See application file for complete search history.

(56) References Cited

U.S. PATENT DOCUMENTS

| | | | | |
|---|---|---|---|---|
| 5,424,812 | A | 6/1995 | Kemmochi et al. | |
| 5,610,696 | A | 3/1997 | Kemmochi et al. | |
| 7,912,390 | B2 | 3/2011 | Mitsui | |
| 7,957,658 | B2 | 6/2011 | Mitsui | |
| 8,548,344 | B2 | 10/2013 | Mitsui | |
| 2004/0141765 | A1* | 7/2004 | Shimura | G03G 15/5041 399/49 |
| 2013/0223861 | A1* | 8/2013 | Kubo | G03G 15/0849 399/53 |
| 2016/0195832 | A1* | 7/2016 | Okada | G03G 15/0849 399/46 |

FOREIGN PATENT DOCUMENTS

| | | | |
|---|---|---|---|
| JP | 2006-300988 | A | 11/2006 |
| JP | 2007-322727 | A | 12/2007 |
| JP | 2009-265282 | A | 11/2009 |

* cited by examiner

*Primary Examiner* — David M. Gray
*Assistant Examiner* — Laura Roth
(74) *Attorney, Agent, or Firm* — Venable LLP

(57) ABSTRACT

An image forming apparatus includes a rotatable image bearing member, a developing device including a developing carrying member and configured to develop an electrostatic image formed on the image bearing member with developer, an electrostatic capacity detecting portion configured to detect information on electrostatic capacity between the developer carrying member and the image bearing member, and a toner content detecting portion configured to detect information on a toner content of the developer accommodated in a developing container. On the basis of the detected electrostatic capacity and the detected toner content, a controller controls a driving speed at which the developer carrying member is rotationally driven.

14 Claims, 9 Drawing Sheets

(a)

(b)

IMAGE FORMING APPARATUS HAVING ELECTROSTATIC CAPACITY DETECTION

FIELD OF THE INVENTION AND RELATED ART

The present invention relates to for an image forming apparatus, using electrophotography, such as a copying machine, a printer, a facsimile machine or a multi-function machine.

In the image forming apparatus using electrophotography, a two-component developer type developing method using a two-component developer consisting of toner and a carrier (hereinafter, simply referred to as a developer) has been widely used. In the image forming apparatus, when a predetermined developing bias voltage is applied to a developing sleeve on which the developer is carried, in a developing region where the developing sleeve and a photosensitive drum opposite each other, the toner in the developer is deposited on an electrostatic latent image on the photosensitive drum, so that a toner image is formed.

In the image forming apparatus, electrostatic capacity between the developing sleeve and the photosensitive drum can be different for every apparatus, for example. As a factor of the difference in electrostatic capacity, for example, it is possible to cite a difference in gap between the developing sleeve and the photosensitive drum (referred to as an SD gap), a change in an amount of the developer per unit time fed to the developing region by the developing sleeve (referred to as a developer feeding amount), a change in toner content of the developer, and the like. When the electrostatic capacity is different, ease of movement of the toner from the developing sleeve to the photosensitive drum in the developing region (referred to as a SD gap portion) (i.e., a developing property) changes, and therefore in some cases, an image defect such as density non-uniformity can be caused. Therefore, an apparatus in which the image defect such as the density non-uniformity is suppressed by detecting the electrostatic capacity and then by changing a developing condition (process condition), of a developing device, such as the developing bias voltage on the basis of the detected electrostatic capacity has been conventionally proposed (Japanese Laid-Open Patent Application (JP-A) 2007-322727).

Incidentally, in the case where the SD gap is relatively narrow or in the case where the developer feeding amount is large (in this case, the electrostatic capacity is high), the density non-uniformity is easily suppressed, and therefore, a uniform image is readily obtained. On the other hand, the developer does not readily pass through the SD gap portion, and therefore, the developer is liable to stagnate. In the case where the developer stagnates during image formation, there is a large liability that another image defect different from the density non-uniformity is caused due to scraping-off of a part of the image or generation of fog, carrier deposition or the like on a white background.

Further, the electrostatic capacity is influenced by a toner content of the toner. That is, even when the SD gap or the developer feeding amount is unchanged, the electrostatic capacity is detected as a low value when the toner content is high, and is detected as a high value when the toner content is low. Further, whether or not the developer is in a state in which stagnation is liable to generate is determined by the SD gap irrespective of the toner content of the developer if the developer feeding amount is the same. Therefore, it is difficult to discriminate whether or not the developer is in the state in which stagnation is liable to generate by making reference to the electrostatic capacity, so that in the case where the developing condition is changed on the basis of the electrostatic capacity as in the above-described apparatus disclosed in JP-A 2007-322727, when the developer stagnates, it becomes difficult to achieve a high image quality in some instances. Thus, in the case where the electrostatic capacity is simply detected and the developing condition is only changed, it was difficult to compatibly realize suppression of the image defect due to the SD gap or the developer feeding amount and suppression of the image defect due to the stagnation of the developer.

A principal object of the present invention is to provide an image forming apparatus capable of reducing an amount of a developer stagnating between an image bearing member and a developer carrying member.

According to an aspect of the present invention, there is provided an image forming apparatus comprising: a rotatable image bearing member; a developing device including a rotatable developer carrying member which is provided spaced from the image bearing member and which is configured to carry a developer including toner and a carrier, the developing device being configured to develop an electrostatic latent image formed on the image bearing member by applying a developing voltage to the developer carrying member; a toner content detecting portion configured to detect a toner ratio of the developer in the developing device; an electrostatic capacity detecting portion configured to detect information on electrostatic capacity between the image bearing member and the developer carrying member when the image bearing member and the developer carrying member rotate; and a switching portion configured to switch a developing condition on the basis of an output of the toner content detecting portion and an output of the electrostatic capacity detecting portion so that the developing condition is changed when the electrostatic capacity reaches first electrostatic capacity at a first toner ratio and so that the developing condition is changed when the electrostatic capacity reaches second electrostatic capacity larger than the first electrostatic capacity at a second toner ratio smaller than the first toner ratio.

Further features of the present invention will become apparent from the following description of exemplary embodiments with reference to the attached drawings.

DESCRIPTION OF THE EMBODIMENTS

Figure 1:
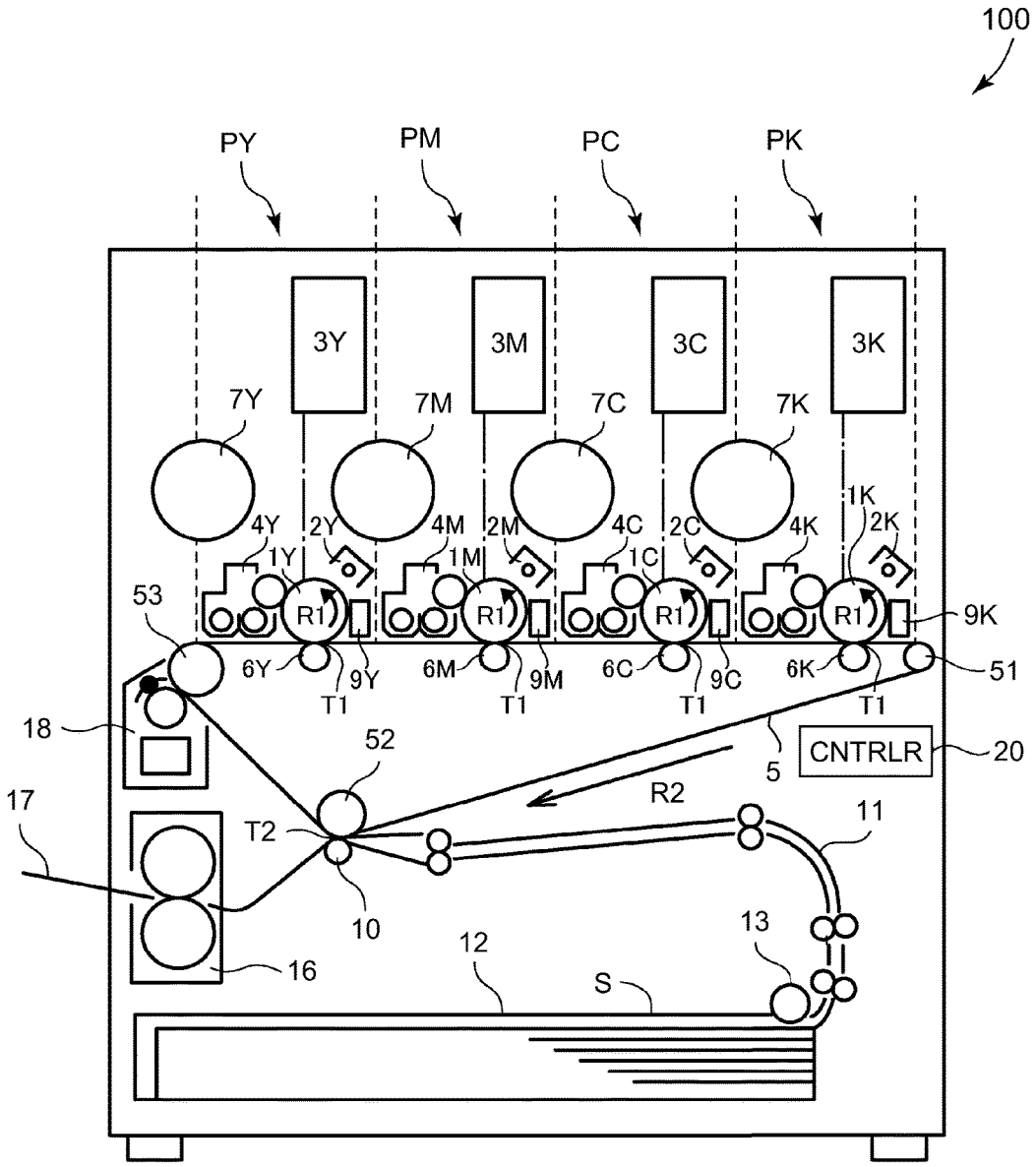
FIG. 1 is a schematic view showing a structure of an image forming apparatus.

Embodiments of the present invention will be described specifically with reference to the drawings. First, an image forming apparatus according to the present invention will be described with reference to FIGS. 1 and 2. FIG. 1 is a schematic view showing a structure of the image forming apparatus. An image forming apparatus 100 shown in FIG. 1 is an intermediary transfer type full-color printer of a tandem type in which image forming portions PY, PM, PC and PK for yellow, magenta, cyan and black are arranged along an intermediary transfer belt 5.

<Image Forming Apparatus>

At the image forming portion PY, a yellow toner image is formed on a photosensitive drum 1Y as an image bearing member and then is transferred onto the intermediary transfer belt 5. At the image forming portion PM, a magenta toner image is formed on a photosensitive drum 1M and then is transferred superposedly onto the yellow image on the intermediary transfer belt 5. At the image forming portion PC and PK, cyan and black toner images are formed on photosensitive drums 1C and 1K, respectively, and then are successively transferred superposedly onto the intermediary transfer belt 5. The four color toner images transferred on the intermediary transfer belt 5 are fed to a secondary transfer portion T2 and are secondary-transferred collectively onto a recording material S (sheet material such as a sheet or an OHP sheet). The recording material S is taken out from a recording material cassette 8 one by one by a feeding roller 13 and is fed to the secondary transfer portion T2 along a feeding path 11.

The image forming portions PY, PM, PC and PK have the substantially same construction except that colors of toners used in developing devices 4Y, 4M, 4C and 4K, respectively, are yellow, magenta, cyan and black, respectively. In the following constituents of the image forming portions are represented by reference numerals or symbols from which suffixes Y, M, C and K for representing a difference in color for the image forming portions PY, PM, PC and PK are omitted, and constitutions and operations of the image forming portions PY to PK will be described.

The image forming portion P includes, at a periphery of the photosensitive drum 1, a primary charger 2, an exposure device 3, the developing device 4, a primary transfer roller 6 and a drum cleaning device 9. The photosensitive drum 1 is prepared by forming a photosensitive layer on an outer peripheral surface of an aluminum cylinder, and is rotated in an arrow R1 direction at a predetermined process speed (e.g., 150 mm/sec).

The primary charger roller 2 irradiates a surface of the photosensitive drum 1 with charged particles with corona discharge, for example, so that the primary charger 2 electrically charges the surface of the photosensitive drum 1 to a uniform negative dark portion potential (surface potential of, e.g., −750 V).

Figure 2:
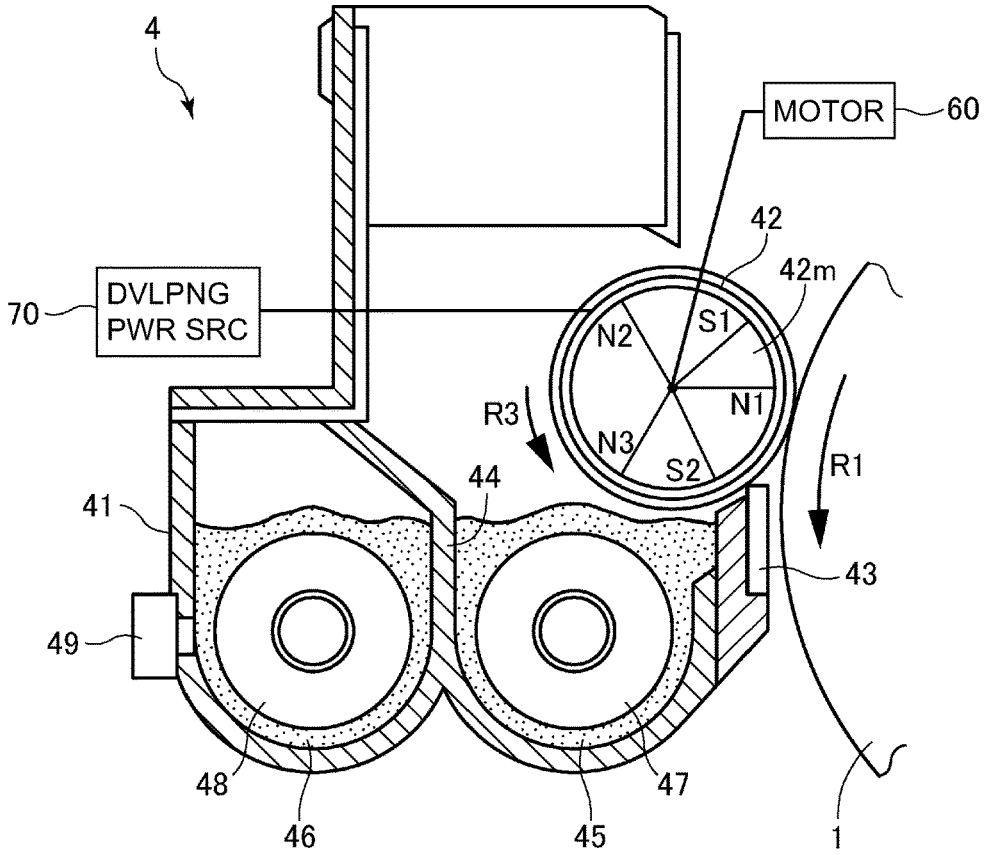
FIG. 2 is a sectional view showing a structure of a developing device.

The exposure device 3 generates a laser beam obtained by subjecting scanning line image data which is developed from an associated color component image to ON-OFF modulation and then scans the photosensitive drum surface with the laser beam through a rotating mirror, so that an electrostatic latent image for an image is formed on the surface of the charged photosensitive drum 1. The developing device 4 supplies the toner to the photosensitive drum 1 and develops the electrostatic latent image into the toner image. The photosensitive drum 4 performs an image forming operation during image formation in accordance with a developing condition (process condition) set by a controller 20. The developing device 4 will be specifically described later (FIG. 2).

The primary transfer roller 6 is disposed opposed to the photosensitive drum 1 via the intermediary transfer belt 5 and forms a toner image primary transfer nip (portion) T1 between the photosensitive drum 1 and the intermediary transfer belt 5. By applying a primary transfer voltage from an unshown high-voltage source to the primary transfer roller 6 at the primary transfer nip T1, the toner image is primary-transferred from the photosensitive drum 1 onto the intermediary transfer belt 5. The drum cleaning device 9 rubs the photosensitive drum 1 with a cleaning blade and removes a primary transfer residual toner slightly remaining on the photosensitive drum 1 after the primary transfer.

The intermediary transfer belt 5 is extended around and supported by a driving roller 53, an inner secondary transfer roller 52, a tension roller 51, and the like, and is driven by the driving roller 53, so that the intermediary transfer belt 5 is rotated in an arrow R2 direction in FIG. 1. A secondary transfer portion T2 is a toner image transfer nip onto a recording material S formed by contact of an outer secondary transfer roller 10 with the intermediary transfer belt 5 stretched by the inner secondary transfer roller 52. At the secondary transfer portion T2, by applying a secondary transfer voltage to the outer secondary transfer roller 10, the toner image is secondary-transferred from the intermediary transfer belt 5 onto the recording material S fed to the secondary transfer portion T2. A secondary transfer residual toner remaining on the intermediary transfer belt 5 while being deposited on the intermediary transfer belt 5 is removed by a belt cleaning device 18. The belt cleaning device 18 removes the secondary transfer residual toner by rubbing the intermediary transfer belt 5 with a cleaning blade.

The recording material S on which the four color images are secondary-transferred at the secondary transfer portion T2 is fed to a fixing device 16. The fixing device 16 heats and presses the recording material S on which the toner images are transferred, so that the toner images are fixed on the recording material S. The recording material S on which the toner image is fixed by the fixing device 16 is discharged to a tray 17 provided outside the image forming apparatus 100.

A toner supplying device 7 supplies to the developing device 4, the toner in an amount corresponding to an amount of the toner consumed depending on consumption of the toner in the developing device 4 with image formation.

<Developing Device>

The developing device 4 will be described using FIG. 2. The developing device 4 shown in FIG. 2 is of a horizontal stirring type in which a developing chamber 45 and a stirring chamber 46 are horizontally provided. The developing device 4 includes the developing container 41 forming a housing, a developing sleeve 42 as a developer carrying member and the regulating blade 43 are provided. In the developing container 41, a two-component developer containing non-magnetic toner and a magnetic carrier is accommodated.

As shown in FIG. 2, the developing sleeve 42 is partly exposed through an opening of the developing container 41 provided at a position opposing the photosensitive drum 1 and is provided rotatably in the developing container 41. The developing sleeve 42 is formed in a cylindrical shape using a non-magnetic material such as aluminum or stainless steel, and inside the developing sleeve 42, a magnet roller 42*m* is fixedly provided. By a magnetic force of a plurality of magnets (N1, N2, N3, S1, S2) provided in the magnet roller 42*m*, on the surface of the developing sleeve 42, a magnetic chain (magnetic brush) of the developer is formed. A layer thickness of the magnetic chain formed on the surface of the developing sleeve 42 is regulated by the plate-like regulating blade 43 constituted by the non-magnetic material. In this embodiment, setting is made so that a center value of the regulated layer thickness of the developer layer is about 30 $mg/cm^2$.

The developing sleeve 42 is disposed close to the photosensitive drum 1 with a predetermined gap (SD gap) with the photosensitive drum 1. The closest distance between the developing sleeve 42 and the photosensitive drum 1, i.e., a distance of the SD gap is kept at, e.g., 300 μm along a rotational axis direction. A region where the photosensitive drum 1 and the developing sleeve 42 oppose each other via the SD gap is the SD gap portion (developing region). The developing sleeve 42 is rotationally driven (in an arrow R3 direction) by a motor 60 as a driving means so that the developing sleeve 42 moves in an opposite direction (counter direction) to a movement direction (arrow R1 direction) at the SD gap portion. That is, in this embodiment, a counter development method is employed. Incidentally, a rotational speed of the developing sleeve 42 is set at, e.g., 225 mm/sec (photosensitive drum peripheral speed ratio=150%) during image formation.

The developing sleeve 42 rotates in an arrow R3 direction while carrying the developer regulated in layer thickness by the regulating blade 43, and thus feeds the developer to the photosensitive drum 1 while rubbing the photosensitive drum 1 with the magnetic chain of the developer at the SD gap portion.

To the developing sleeve 42, a developing bias voltage in the form of a DC voltage biased with an AC voltage is applied from a developing-voltage source 70 as a developing voltage applying means. For example, an oscillating voltage of a blank pulse wave in the form of a DC voltage of −610 V biased with an AC voltage of a rectangular wave of 1700 V in peak-to-peak voltage and 14 kHz in frequency is applied. As a result, the toner is supplied to the electrostatic latent image formed on the photosensitive drum 1, so that the electrostatic latent image is developed into the toner image.

An inside of the developing container 41 is partitioned, with respect to a horizontal direction, into a right-side developing chamber 45 and a left-side stirring chamber 46 by a partition wall 44 extending in a vertical direction at a substantially central portion. The developing chamber 45 and the stirring chamber 46 communicate with each other at both end portions of the partition wall 44, and form a circulation path of the developer.

In chambers consisting of the developing chamber 45 and the stirring chamber 46, a developing screw 47 and a stirring screw 48 are rotatably provided, respectively. Each of the developing screw 47 and the stirring screw 48 has a screw structure including a blade formed spirally around a rotation shaft. Therefore, by rotation of the developing screw 47 and the stirring screw 48, the developer is circulated and fed in the developing container 41 while being stirred. With the feeding of the developer while stirring the developer, the toner is negatively charged and the carrier is positively charged.

As regards the stirring chamber 46, in order to detect the toner content of the developer accommodated in the developing device (stirring chamber 46 in this case) an inductance sensor 49 is provided. The inductance sensor 49 as a toner content detecting means outputs, as a detection signal, a voltage value depending on magnetic permeability of the developer by using an inductance of a coil. That is, in the inductance sensor 49, in the case where the toner content of the developer is small, a proportion of the magnetic carrier contained in the developer in a unit volume becomes large and therefore apparent permeability of the developer becomes high, so that the voltage value (peak voltage) becomes high. On the other hand, in the case where the toner content of the developer is large, the proportion of the magnetic carrier contained in the developer in the unit volume becomes small and therefore the apparent permeability of the developer becomes low, so that the voltage value becomes low.

[Controller]

Figure 3:
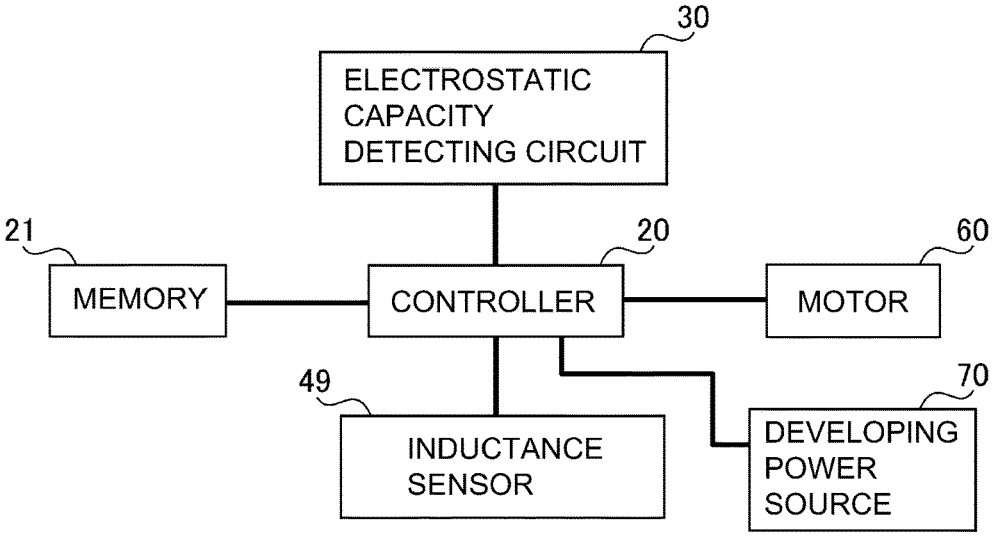
FIG. 3 is a control block diagram of a developing sleeve control system.

The image forming apparatus 100 includes the controller 20 as a control means as shown in FIG. 1. The controller 20 will be described using FIG. 3. FIG. 3 is a control block diagram of a developing sleeve control system for controlling the developing sleeve 42. Incidentally, to the controller 20, other members such as the photosensitive drum 1, the primary charger 2, the exposure device 3, the primary transfer roller 6, the drum cleaning device 9, the intermediary transfer belt 5, motors and power sources for driving these members, and the like are also connected, but are omitted from illustration and description.

The controller 20 is, e.g., CPU (central processing unit) for effecting various control operations such as image formation and the like. As shown in FIG. 3, to the controller 20, a memory 21 is connected via an unshown interface. The memory 21 as a storing means is ROM, RAM or a hard disk or the like, and stores various programs and data and the like for controlling the image forming apparatus 100. For example, in the memory 21, programs for performing various control operations such as an image forming job and toner supply, a developing condition during a normal operation (such as a rotational speed of the developing sleeve 42), or data such as a table relating to electrostatic capacity between the developing sleeve 42 and the photosensitive drum 1 are stored. The memory 21 is also capable of temporarily storing a processing (computation) result with execution of the program. Herein, "during the normal operation" is before the developing condition is changed.

The controller 20 is capable of executing, on the basis of an input of image information or the like from an external terminal, an image forming process (an operation in an image forming mode) stored in the memory 21 in advance. The controller 20 controls the image forming apparatus 100 so that an image forming job is carried out by executing the image forming process. The image forming job is a series of operations from a start of image formation based on a print signal for forming an image on the recording material until an image forming operation is completed. Specifically, the image forming job refers to operations from during pre-rotation after receiving the print signal (from a preparatory operation before the image formation) to post-rotation (operation after the image formation) and includes an image forming period and sheet interval (during non-image formation).

The controller 20 is also capable of executing a toner supplying process (toner supplying program) stored in the memory 21 in advance by being timed to the execution of the image forming process. The controller 20 controls the toner supplying device 7 depending on a comparison between a toner content detected on the basis of a voltage value acquired from the inductance sensor 49 and a target value stored in the memory 21 in advance. For example, in the case where the detected toner content is lower than the target value, the controller 20 controls the toner supplying device 7 so as to supply the toner. As a result, the toner content of the developer in the developing container 41 is maintained at a desired density (toner content).

To the controller 20, a motor 60 for driving the developing sleeve 42 and the developing voltage source 70 are connected. As specifically described later (FIG. 7), in this embodiment, image formation is effected by appropriately changing the developing condition of the developing device 4 during the operation in the image forming mode. In this embodiment, the developing condition of the developing device 4 is a condition set for causing the developing device 4 to perform a desired image forming operation during the image formation. As described later, in this embodiment, as the developing condition, the rotational speed of the developing sleeve 42 is changed, for example. The controller 20 controls the motor 60 for changing the rotational speed of the developing sleeve 42.

Figure 4:
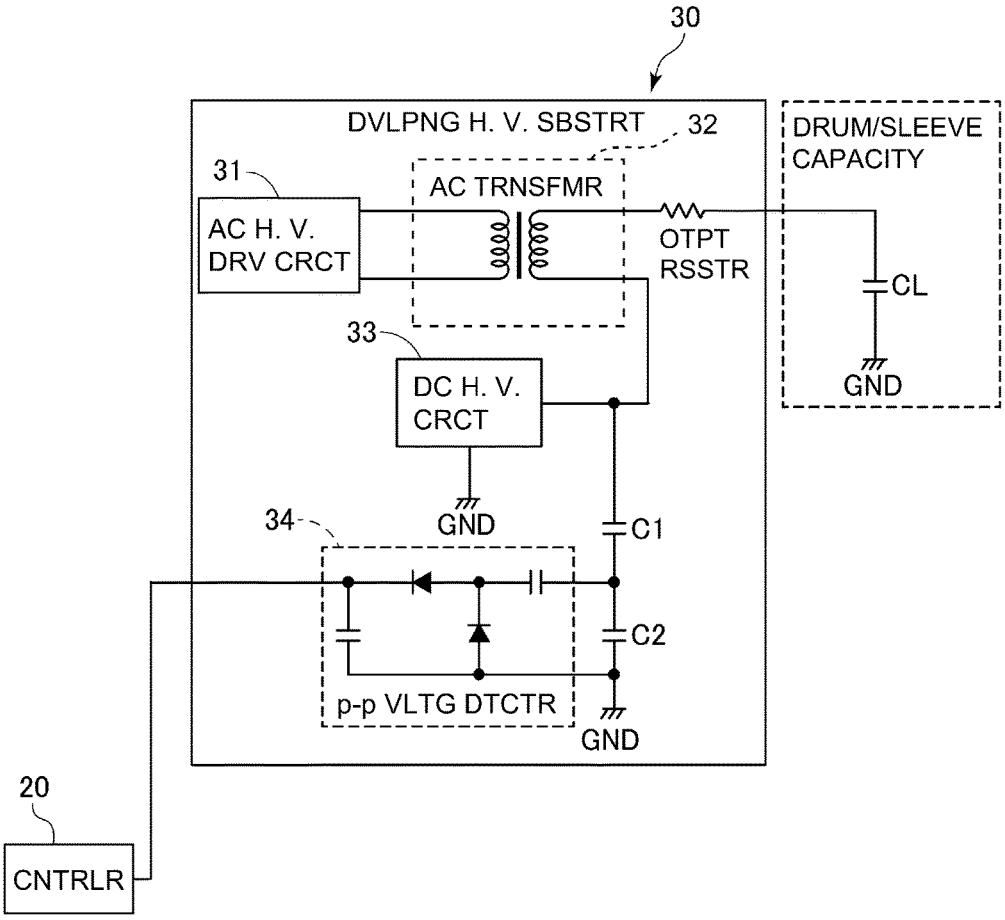
FIG. 4 is a circuit view showing an electrostatic capacity detecting circuit.

The developing condition is changed on the basis of the electrostatic capacity between the developing sleeve 42 and the photosensitive drum 1. Therefore, in order to detect the electrostatic capacity between the developing sleeve 42 and the photosensitive drum 1, to the controller 20, an electrostatic capacity detecting circuit 30 is connected. The electrostatic capacity detecting circuit 30 as an electrostatic capacity detecting means may be a known one, and an example thereof is shown in FIG. 4. FIG. 4 is a circuit diagram showing the electrostatic capacity detecting circuit 30.

[Electrostatic Capacity Detecting Circuit]

As shown in FIG. 4, the electrostatic capacity detecting circuit 30 includes an AC high-voltage driving circuit 31, an AC transformer 32, a DC high-voltage driving circuit 33, an amplitude (p-p voltage) detecting circuit 34, capacitors C1 and C2, and an output resistor. The AC high-voltage driving circuit 31 generates a developing AC bias voltage and supplies the voltage to the developing sleeve 42. The DC high-voltage driving circuit 33 generates a developing DC bias voltage and supplies the voltage to the developing sleeve 42. In the case where the AC high-voltage driving circuit 31 and the DC high-voltage driving circuit 33 apply predetermined voltages to the developing sleeve 42, a current flows through the SD gap portion (replaced with a virtual capacitor CL in the circuit).

The current flowing through the SD gap portion (virtual capacitor CL) is detected by an amplitude (p-p voltage) detecting circuit 34. That is, the amplitude detecting circuit 34 can detect the current flowing toward a secondary side of the AC transformer 32 by the capacitors C1 and C2. The amplitude detecting circuit 34 converts an AC component into a DC component in accordance with a peak-to-peak voltage (p-p voltage) between both ends the capacitor C2. The DC-converted voltage (DC voltage) is converted from an analog signal into a digital signal by an unshown A/D conversion circuit, and is inputted into the controller 20.

On the basis of the inputted DC voltage, the controller 20 detects electrostatic capacity between the developing sleeve 42 and the photosensitive drum 1. The controller 20 may only be required to be capable of specifying the electrostatic capacity by an appropriate method such as calculation by a predetermined calculation formula or determination by making reference to a table, showing a relationship between the voltage and the electrostatic capacity, prepared in the memory 21 in advance.

Figure 5:
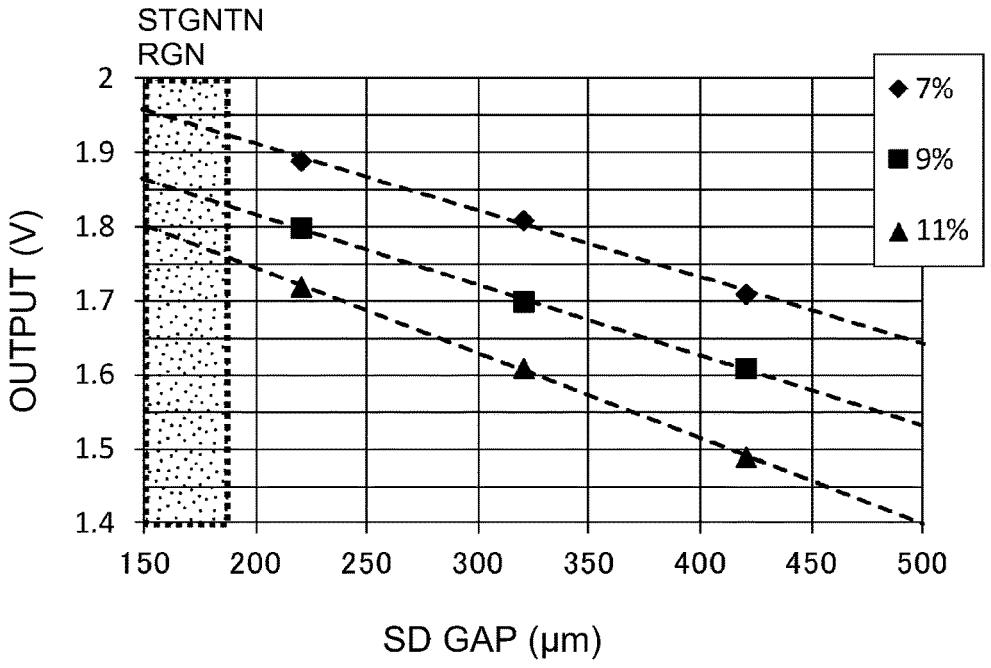
In FIG. 5, (a) and (b) are graphs each showing an output of the electrostatic capacity detecting circuit, in which (a) shows a relationship with an SD gap, and (b) shows a relationship with a developer feeding amount.
Figure 5:
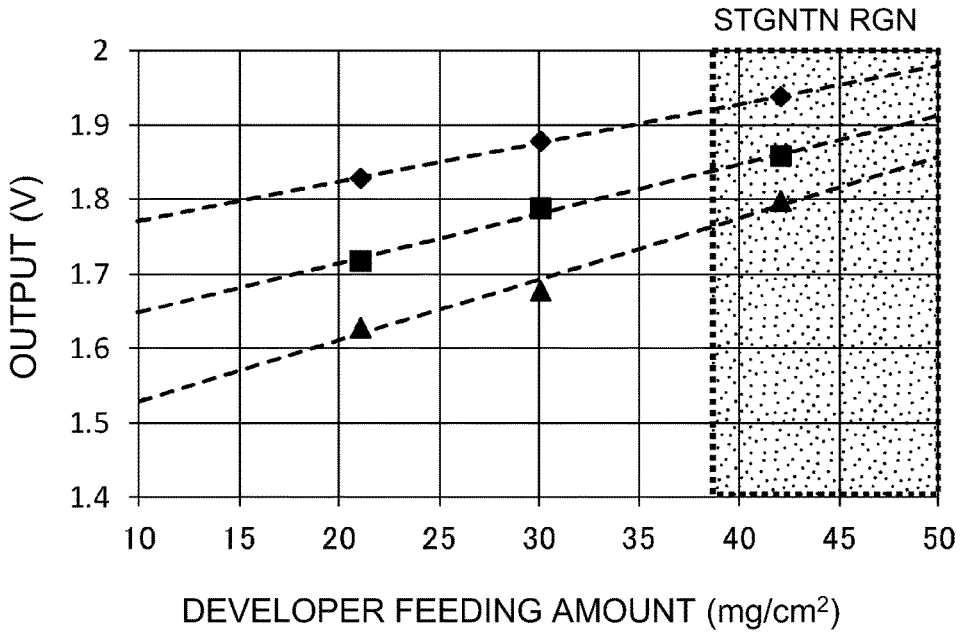

In FIG. 4, each of (a) and (b) shows a voltage value outputted from the above-described electrostatic capacity detecting circuit 30. In FIG. 5, (a) shows the voltage value outputted from the electrostatic capacity detecting circuit 30 when the SD gap is changed, and (b) shows the voltage value outputted from the electrostatic capacity detecting circuit 30 when the developer feeding amount is changed. However, the relationship between the voltage value and the electrostatic capacity shown in (a) of FIG. 3 corresponds to the case where the developer feeding amount is set at 37 mg/cm$^2$ in which stagnation of the developer is liable to generate as shown in (b) of FIG. 5. Incidentally, the voltage value of the electrostatic capacity detecting circuit 30 increases or decreases in proportion to the electrostatic capacity between the developing sleeve 42 and the photosensitive drum 1.

As can be understood from (a) of FIG. 5, the electrostatic capacity between the developing sleeve 42 and the photosensitive drum 1 increases with a narrowing SD gap. Further, even when the SD gap is the same, the electrostatic capacity is different when the toner content is different. Further, in the case where the SD gap is 180 μm or less, the developer stagnation generates irrespective of the toner content, and also the voltage value outputted from the electrostatic capacity detecting circuit 30 at that time is different depending on the toner content.

As can be understood from (b) of FIG. 5, the electrostatic capacity between the developing sleeve 42 and the photosensitive drum 1 increases with an increasing developer feeding amount on the developing sleeve 42. Further, even when the developer feeding amount is the same, the electrostatic capacity is different when the toner content is different. Further, in the case where the developer feeding amount is about 37 mg/cm$^2$ or more, the developer stagnation generates irrespective of the toner content, and also the voltage value outputted from the electrostatic capacity detecting circuit 30 at that time is different depending on the toner content. Thus, the electrostatic capacity between the developing sleeve 42 and the photosensitive drum 1 varies depending on the SD gap and the developer feeding amount and further depending on the toner content of the developer.

Incidentally, the electrostatic capacity between the developing sleeve 42 and the photosensitive drum 1 exhibits variation for each of the image forming portions PY to PK. For that reason, the controller 20 is capable of detecting the electrostatic capacity for each of the image forming portions PY to PK by using the electrostatic capacity detecting circuit 30 and is capable of storing the electrostatic capacity in the memory 21 for each of the image forming portions PY to PK. That is, the electrostatic capacity detecting circuit 30 is disposed for each of the image forming portions PY to PK.

As described above, when the SD gap is narrowed or the developer feeding amount is increased, the density (toner content) non-uniformity can be suppressed. However, the developer does not readily pass through between the developing sleeve and the photosensitive drum and is liable to stagnate. In the case where the developer stagnates, a part of the image is removed, or fog or carrier deposition or the like generates on a white background, so that another image defect different from the density non-uniformity can be caused. Here, stagnation of the developer which can generate at the SD gap will be described using (a) to (c) of FIG.

Figure 6:
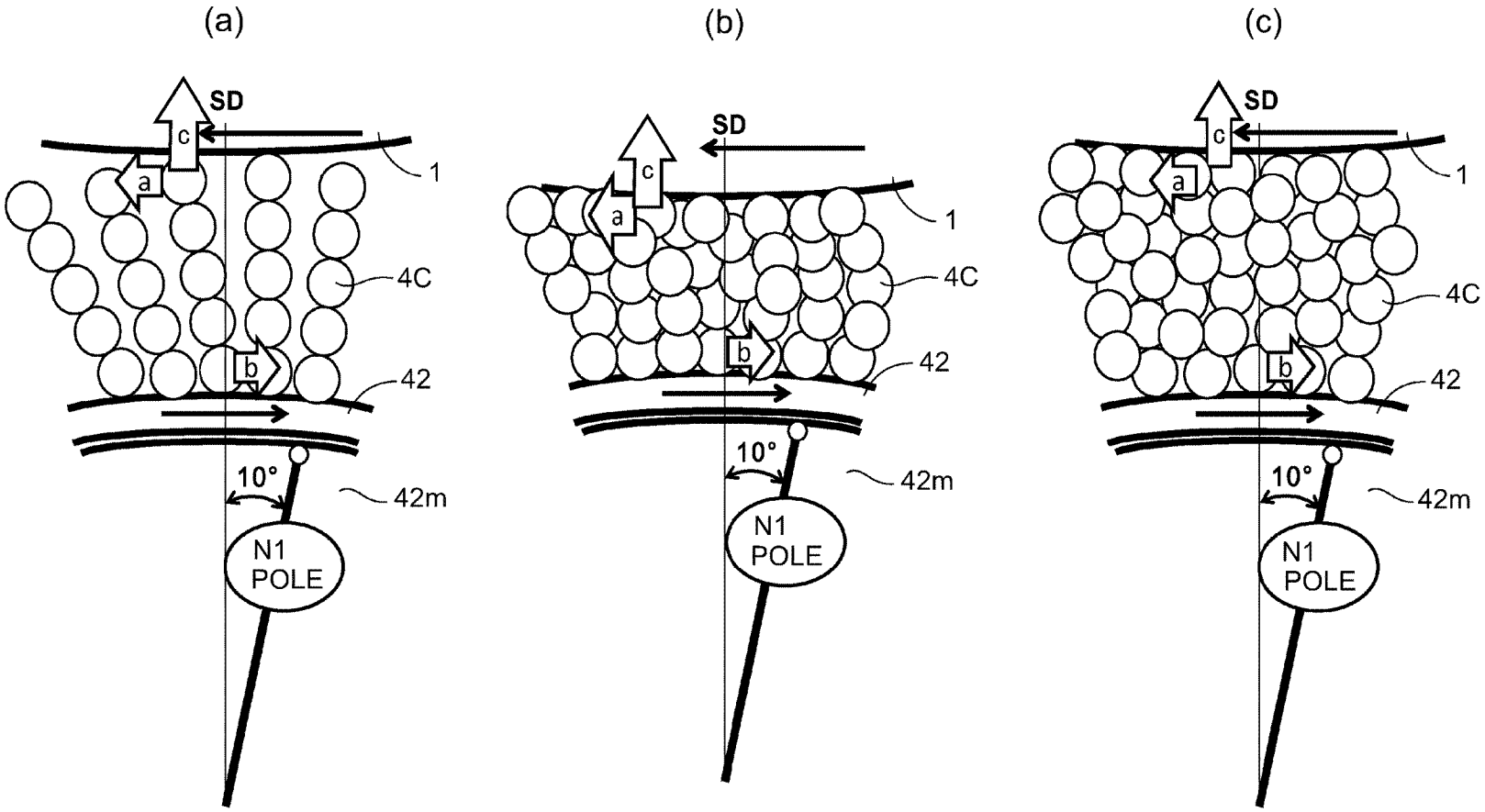
FIG. 6, (a) to (c) are schematic views each for illustrating stagnation of a developer, in which (a) shows the case where the SD gap and the developer feeding amount are reference values, (b) shows the case where the SD gap is narrower than the reference value gap, and (c) shows the case where the developer feeding amount is larger than the reference value.

6. In FIG. 6, (a) to (c) show behavior of the developer at the SD gap. In these figures, a rectilinear line SD represents the closest position between the photosensitive drum 1 and the developing sleeve 42 at the SD gap for simplicity.

As shown in (a) of FIG. 6, in the case where the SD gap and the developer feeding amount are reference values, a carrier 4C of the developer is in an erected state (chain state) extending along magnetic lines of force extending from a magnet (N1 pole) of the magnet roller 42*m*. The carrier 4C is fed by rotation of the developing sleeve 42 while being attracted to the developing sleeve 42 by a magnetic force of the magnet (N1 pole), and therefore the carrier 4C is moved in an arrow b direction in (a) of FIG. 6. At that time, the carrier 4C contacting the photosensitive drum 1 is pulled in an arrow a direction in (a) of FIG. 6 by rotation of the photosensitive drum 1. For that reason, a force acting on the carrier 4C in the arrow a direction is a resisting force when the developer passes through the SD gap. Further, in the case of the counter development type, the force acting on the carrier 4C in the neighborhood of the developing sleeve 42 and the force acting on the carrying 4C in the neighborhood of the photosensitive drum 1 are opposite in direction to each other, so that it can be said that the stagnation of the developer is liable to generate.

During the image formation, in order to prevent the toner from moving toward the photosensitive drum 1 at the white background portion of the image, a potential difference (referred to as Vback) is set between the dark portion potential of the photosensitive drum 1 in a non-image region where the electrostatic latent image is not formed and a potential of the developing sleeve 42. For example, in the case where the dark portion potential of the photosensitive drum 1 is −750 V, a DC component of the developing bias voltage is −610 V, so that Vback is set at 140 V. In the case of this embodiment, the carrier 4C is charged to an opposite polarity to the charge polarity of the toner, and therefore when Vback is applied, the carrier 4C is attracted toward the photosensitive drum 1 side. With a larger Vback, the carrier 4C is more strongly attracted to the photosensitive drum 1, so that the force in the arrow a direction acts on the carrier 4C more strongly, and therefore the stagnation of the developer is liable to occur.

As shown in (b) of FIG. 6, in the case where the SD gap is narrower than the reference value, the carrier 4C is confined together with the toner in a narrow space. Then, the force acting in the arrow a direction in (b) of FIG. 6 on the carrier 4C contacting the photosensitive drum 1 is stronger than the force in the case of (a) of FIG. 6, and therefore the stagnation of the carrier is liable to generate.

As shown in (c) of FIG. 6, in the case where the developer feeding amount is larger than the reference value, even when the SD gap is the reference value, a length of the chain of the carrier 4C becomes long. For that reason, the carrier 4C contacts the photosensitive drum 1 in a larger amount, so that the force acting in the arrow a direction in (c) of FIG. 6 on the carrier 4C contacting the photosensitive drum 1 is stronger than the force in the case of (a) of FIG. 6, and therefore the stagnation of the carrier is liable to generate.

Particularly, in the case of the counter development type, there is a disadvantage that the stagnation of the developer is liable to generate when compared with a normal development type in which movement directions of the developing sleeve 42 and the photosensitive drum 1 are the same as the SD gap portion. However, the counter development type has an advantage that a developing property is relatively high compared with the normal development type. Therefore, for example, in the case where half-tone images and solid images are continuously formed, a white patch is not readily generated on a trailing end portion of the half-tone image. In consideration of these advantage and disadvantage, either one of the normal development type and the counter development type is employed. In this embodiment, the counter development type is employed.

Incidentally, the photosensitive drum 1 and the developing sleeve 42 individually have component tolerances, and therefore when the SD gap is provided and the photosensitive drum 1 and the developing sleeve 42 are disposed in the apparatus main assembly, an adjustment tolerance may preferably be largely ensured for adjusting the SD gap. However, as a result, the SD gap can vary for each of the image forming portions PY to PK. Therefore, it would be considered that a developing sleeve is changed so as not to cause the stagnation in the case where the electrostatic capacity between the developing sleeve 42 and the photosensitive drum 1 is detected, and on the basis thereof, whether or not the developer is in a state in which the stagnation is liable to generate and as a result, the developer is in the state in which the stagnation is liable to generate.

The electrostatic capacity varies depending on the SD gap and the developer feeding amount, and therefore, whether or not the developer is in the state in which the stagnation is liable to generate can be discriminated by the electrostatic capacity to some extent. However, the toner content of the developer varies depending on image formation, so that a fluctuation in toner content means a change in weight of the carrier contained in the developer per unit weight. For that reason, even when each of the SD gap and the developer feeding amount is the same, the electrostatic capacity can vary depending on the toner content. On the other hand, whether or not the developer is in the state in which the stagnation is liable to generate is determined by the SD gap irrespective of the toner content when the developer feeding amount is the same.

This will be specifically described using (a) of FIG. 5. For example, in the case where the toner content is 9%, when the voltage value of the electrostatic capacity detecting circuit 30 is about 1.825 (V), the SD gap is in a state (180 μm or less in this case) in which the developer is liable to stagnate. On the other hand, in the case where the toner content is 7%, even when the voltage value of the electrostatic capacity detecting circuit 30 is about 1.825 (V), the SD gap is not in the state in which the developer is liable to stagnate. Thus, even when the voltage value of the electrostatic capacity detecting circuit 30, i.e., the electrostatic capacity between the developing sleeve 42 and the photosensitive drum 1 is the same, the SD gap can change when the toner content is different. For that reason, when reference to the electrostatic capacity is only made simply as in a conventional constitution, it is difficult to discriminate whether or not the SD gap is in the state in which the developer is liable to stagnate. Accordingly, factors such as a fluctuation in environment and a fluctuation in durability and the like are taken into consideration, and it was difficult to compatibly realize suppression of the image defect due to the SD gap and the developer feeding amount and suppression of the image defect due to the stagnation of the developer.

Therefore, in this embodiment, in view of the above, in the case where the developing condition for operating the developing device during image formation is changed on the basis of the electrostatic capacity, suppression of the image defect due to the change in electrostatic capacity and suppression of the image defect due to the stagnation of the developer was able to be compatibly realized. This will be described below.

First Embodiment

Figure 7:
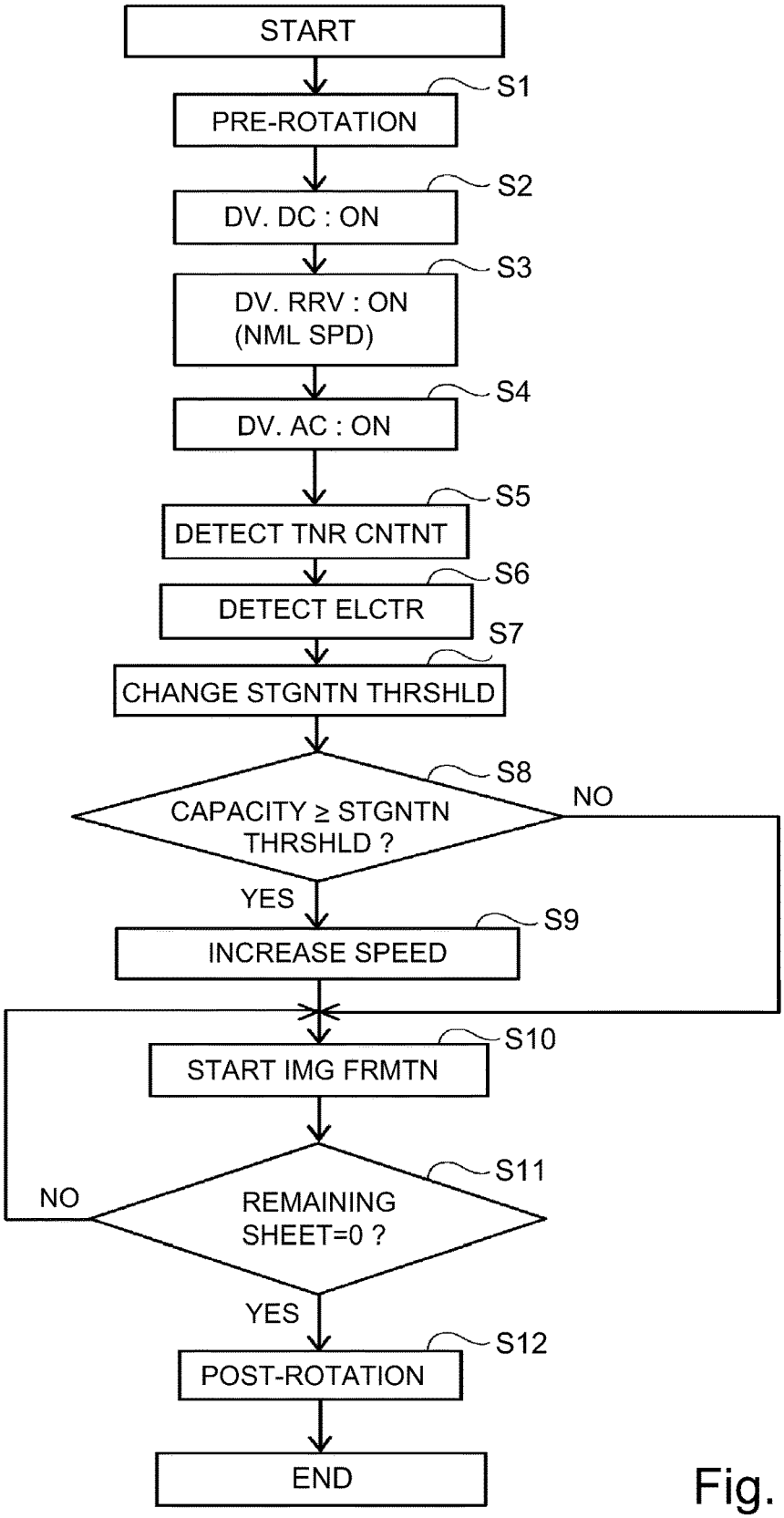
FIG. 7 is a flowchart of an image forming process in a First Embodiment.
Figure 8:
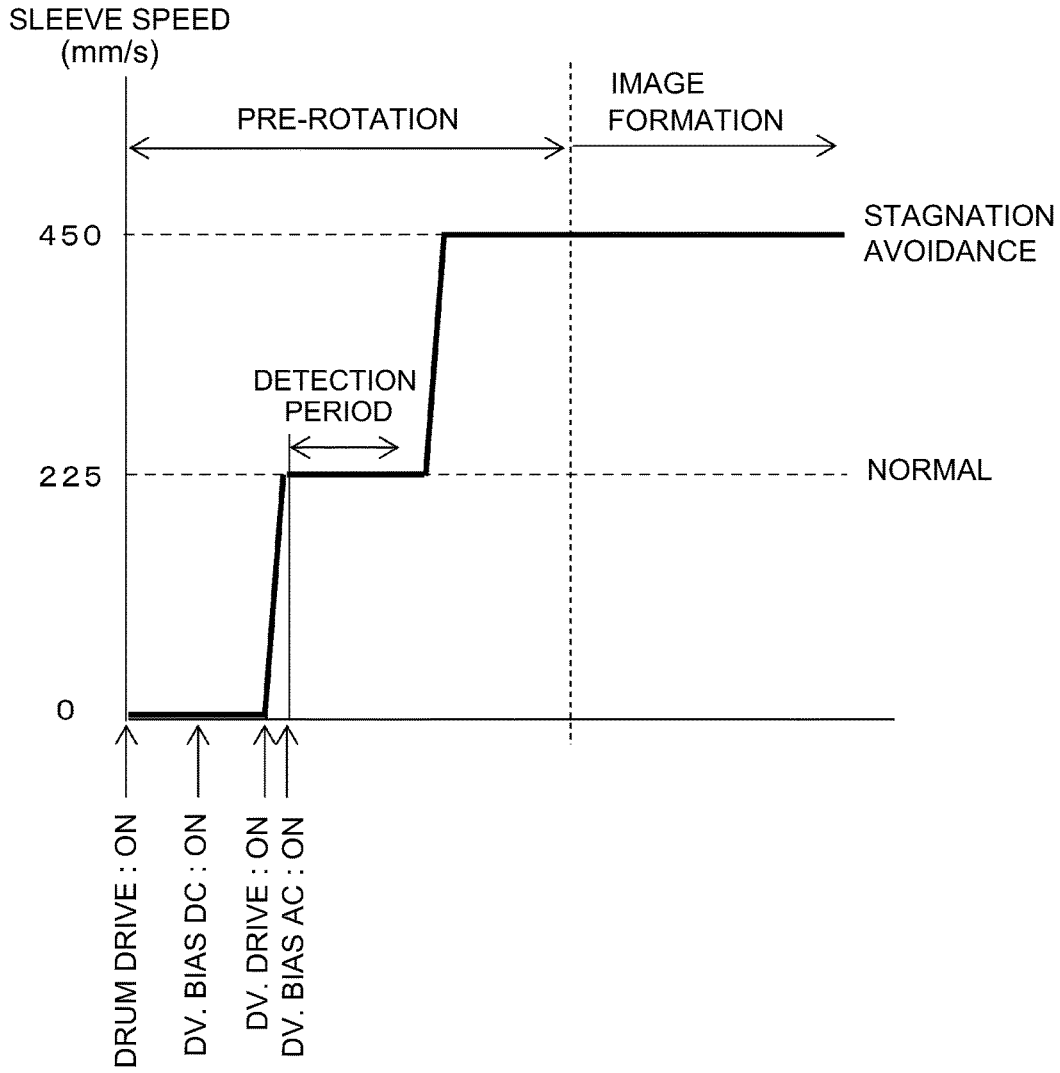
FIG. 8 is a time chart for illustrating rotation control of a developing sleeve.

An image forming process (operation in an image forming mode) in the First Embodiment will be described using FIGS. 7 and 8 while making reference to FIGS. 1 to 3 and (a) of FIG. 6 and the like. The image forming process shown in FIG. 7 is started upon receipt of a print signal by the controller 20. The controller 20 executes the image forming process for each of the image forming portions PY to PK. Processes of S1 to S9 shown in FIG. 7 are carried out during pre-rotation.

As shown in FIG. 7, the controller starts a pre-rotation operation (S1). After rotation of the photosensitive drum 1 is started, when charging of the photosensitive drum 1 is started by controlling the primary charger 2, the controller 20 controls the developing voltage source 70, so that application of a DC component of the developing bias voltage is started (S2, developing DC: ON). Then, the controller 20 controls the motor 60, so that the developing sleeve 42 is rotated at a predetermined rotational speed (e.g., 225 mm/sec) (S3, developing drive: ON), and further controls the developing voltage source 70, so that application of an AC component of the developing bias voltage is started (S4, developing AC: ON). In this way, when the developing device 4 is operated under a predetermined developing condition during normal state (before change in developing condition) stored in the memory 21 in advance, the electrostatic capacity ea can be detected in a state in which the behavior of the developer at the SD gap portion is the same as that during the normal state.

When the developing device 4 is operated, the controller 20 detects the toner content on the basis of the voltage acquired from the inductance sensor 49 (S5). Specifically, the controller 20 calculates an average Vc on the basis of a plurality of voltage values of the inductance sensor 49 acquired in a time (e.g., 150 msec) corresponding to one full turn (cyclic) period of the stirring screw 48 (FIG. 2). Then, the controller 20 obtains a toner content Td by the following formula (1) on the basis of the calculated average Vc, a reference voltage value Vt stored in the memory 21 in advance and sensitivity coefficient Rt (output fluctuation value per toner content of 1%).

$$Td\ (\%)=9(\%)+(Vt-Vc)/Rt \quad (1)$$

In this embodiment, the reference voltage value is set at a voltage value when the toner content is 9%, and in the case where the average Vc is equal to the reference voltage value, the toner content is detected as being 9%. In the case of (reference voltage value Vt)>(average Vc), the toner content is higher than 9%. For example, in the case of (Vt-Vc)/Rt=1.2, the toner content is detected as being 10.2%. On the other hand, in the case of (reference voltage value Vt)< (average Vc), the toner content is detected as a value lower than 9%. Thus, the toner content of the developer is detected.

The controller 20 detects the electrostatic capacity between the developing sleeve 42 and the photosensitive drum 1 on the basis of the voltage value inputted from the electrostatic capacity detecting circuit 30 (S6). FIG. 8 shows timing when the electrostatic capacity is detected. As the timing when the electrostatic capacity is detected, it is desirable that the electrostatic capacity is detected in a state in which the developing sleeve 42 is driven at the same rotational speed as that during the normal state and in which the same developing bias voltage is applied ("DETECTION PERIOD" in FIG. 8). This is because even when the electrostatic capacity is detected when, e.g., the developing sleeve 42 is at rest, the behavior of the developer at the SD gap portion is different from that during the image formation and therefore a proper electrostatic capacity cannot be detected. Further, when the developing bias voltage is not applied, a force for attracting the carrier to the photosensitive drum 1 does not act on the carrier ((a) of FIG. 6), and also in this case, the behavior of the developer at the SD gap portion is different from that during the image formation and therefore the proper electrostatic capacity cannot be detected. Incidentally, the toner content detecting timing may preferably be the same timing as the electrostatic capacity detecting timing ("DETECTION PERIOD" in FIG. 8).

Returning to FIG. 7, the controller 20 changes a stagnation threshold on the basis of the detected toner content (S7). The stagnation threshold is a voltage value for discriminating whether or not there is a sign of generation of the stagnation of the developer, and is stored as a table in the memory 21 in advance. The table which has already been stored in the memory 21 is shown in Table 1 below. As shown in Table 1, as regards the stagnation threshold, for each of predetermined toner contents, a voltage value obtained by an experiment is associated. For example, in the case where the toner content is 6.0(%), the stagnation threshold is determined as 1.95 (V) on the basis of Table 1.

TABLE 1

| TC*1 (%) | ST*2 (V) |
|---|---|
| 4.0 | 2.07 |
| 5.0 | 2.01 |
| 6.0 | 1.95 |
| 7.0 | 1.90 |
| 8.0 | 1.85 |
| 9.0 | 1.80 |
| 10.0 | 1.76 |
| 11.0 | 1.72 |
| 12.0 | 1.69 |

*1"TC" is the toner content.
*2"ST" is the stagnation threshold.

Incidentally, as regards stagnation thresholds, for the toner contents, other than those listed in Table 1 may be determined by performing linear interpolation. Further as regards stagnation thresholds, for the toner contents, less than the toner content of 4.0% and more than the toner content of 12% may be determined by performing extrapolation by using the respective values in the table. Incidentally, a method of determining the stagnation threshold is not limited to the method of determining the stagnation threshold on the basis of the table as shown in Table 1, but may also be a method of determining the stagnation threshold by using a predetermined calculation formula, for example.

The controller 20 compares the electrostatic capacity detected by the process of S6 with the stagnation threshold changed by the process of S7, and discriminates whether or not the electrostatic capacity is not less than the stagnation threshold (S8). In the case where the controller 20 discriminated that the electrostatic capacity is smaller than the stagnation threshold (NO of S8), the controller 20 starts image formation while maintaining the developing condition during the normal state (S10). In this case, as shown as "NORMAL" in FIG. 8, the image formation is effected while the rotational speed of the developing sleeve 42 is maintained.

On the other hand, in the case where the controller 20 discriminated that the electrostatic capacity is not less than the stagnation threshold (YES of S8), the controller 20 changes the DC (S9). Specifically, the controller 20 prolongs the time of the pre-rotation and controls the motor 60 and thus increases the rotational speed of the developing sleeve 42 so as to be faster than the rotational speed, during the normal state, stored in the memory 21 in advance. For example, the controller 20 rotates the developing sleeve 42 as shown as "STAGNATION AVOIDANCE" in FIG. 8 at a rotational speed (450 mm/sec, photosensitive drum peripheral speed ratio=300%) which is twice the rotational speed during the normal state. When the rotational speed of the developing sleeve 42 is changed to twice, the developer feeding amount increases to twice thereof. Further, a peripheral speed ratio to the photosensitive drum 1 increases, and therefore, the amount of the developer moved in the arrow b direction in (a) of FIG. 6 against the force for pulling the carrier in the arrow a direction in (a) of FIG. 6 by the photosensitive drum 1 increases relatively. Then, the amount of the developer passing through the SD gap increases, so that the stagnation of the developer does not readily generate.

After the process of S9, the controller 20 starts the image formation in the changed developing condition, i.e., in a state in which the rotational speed of the developing sleeve 42 is increased in this case (S10). Incidentally, in the case where there is a liability that an image density largely changes with the change in rotational speed of the developing sleeve 42, the image formation may be started after carrying out gradation control. Then, the controller 20 discriminates whether or not a remaining print number is 0 (S11). In the case where the controller 20 discriminated that the remaining print number is not 0 (NO of S11), the sequence is returned to the process of S10 and subsequently the controller 20 effects the image formation. On the other hand, in the case where the controller 20 discriminated that the remaining print number is 0 (YES of S11), the controller 20 executes post-rotation control (S12), and then ends the image forming process.

As described above, in this embodiment, depending on the comparison between the stagnation threshold and the electrostatic capacity between the developing sleeve 42 and the photosensitive drum 1, the developing condition (the rotational speed of the developing sleeve 42) of the developing device 4 is changed, so that suppression of the image defect due to the SD gap and the developer feeding amount is realized. At that time, in advance of the execution of the process of changing the developing condition on the basis of the electrostatic capacity, the toner content of the developer is detected and depending on the detected toner content, the stagnation threshold to be compared with the electrostatic capacity for determining whether or not the developing condition should be changed is capable of being changed. Thus, even when the electrostatic capacity is influenced by the toner content, whether or not the SD gap is in the state in which the stagnation of the developer is liable to generate can be properly discriminated, so that even when the SD gap is in the state in which the stagnation of the developer is liable to generate, the developing condition can be set to a developing condition capable of avoiding the stagnation of the developer. Thus, in this embodiment, it is possible to not only suppress the image defect due to the SD gap and the developer feeding amount but also suppress the image defect due to the stagnation of the developer.

Further, in the state in which the behavior of the developer at the SD gap portion is the same as that during the image formation, i.e., in a state in which the developer behavior is the same as that in the stagnation state of the developer capable of generating during the image formation, the electrostatic capacity is made detectable, and therefore it is possible to properly discriminate whether or not the SD gap is in the state in which the developer stagnation is liable to generate.

Further, in the case where the rotational speed of the developing sleeve 42 is increased as described above, deterioration of the developer can be promoted early. For example, when the rotational speed of the developing sleeve 42 is made twice, the deterioration of the developer is promoted at the rotational speed twice the rotational speed before the change. Therefore, in view of this point in this embodiment, the rotational speed of the developing sleeve 42 is made fast only in the state in which the developer is liable to state, so that it is possible to realize the suppression of the above-described image defect without promoting the deterioration of the developer to the extent possible.

Second Embodiment

The Second Embodiment will be described. As the image forming apparatus 100, there is an image forming apparatus operable in a state in which an image forming mode thereof is switched to a different image forming mode between during plain paper printing and during thick paper printing. For example, during the plain paper printing, the image forming apparatus operates in a constant-speed mode in which the photosensitive drum 1 is rotated at 150 mm/sec and the developing sleeve 42 is rotated at 225 mm/sec. On the other hand, during the thick paper printing, the image forming apparatus operates in a low-speed mode in which the photosensitive drum 1 and the developing sleeve 42 are rotated at 75 mm/sec and 112.5 mm/sec, respectively, which are ½ of those in the constant-speed mode.

Even in the image forming apparatus 100 capable of switching the image forming mode, a process similar to the image forming process (FIG. 7) described in Embodiment 1 is executed by the controller 20. However, between during the constant-speed mode and during the low-speed mode, the rotational speeds of the developing sleeve 42 during the normal state are different from each other, so that the rotational speeds of the developing sleeve 42 are different when the developing condition is changed (S9). As regards the constant-speed mode, as described above with reference to FIG. 7, the rotational speed of the developing sleeve 42 is changed and therefore will be omitted from description. The low-speed mode will be described using FIG. 9 while making reference to FIGS. 1 to 3 and 7 and the like.

Figure 9:
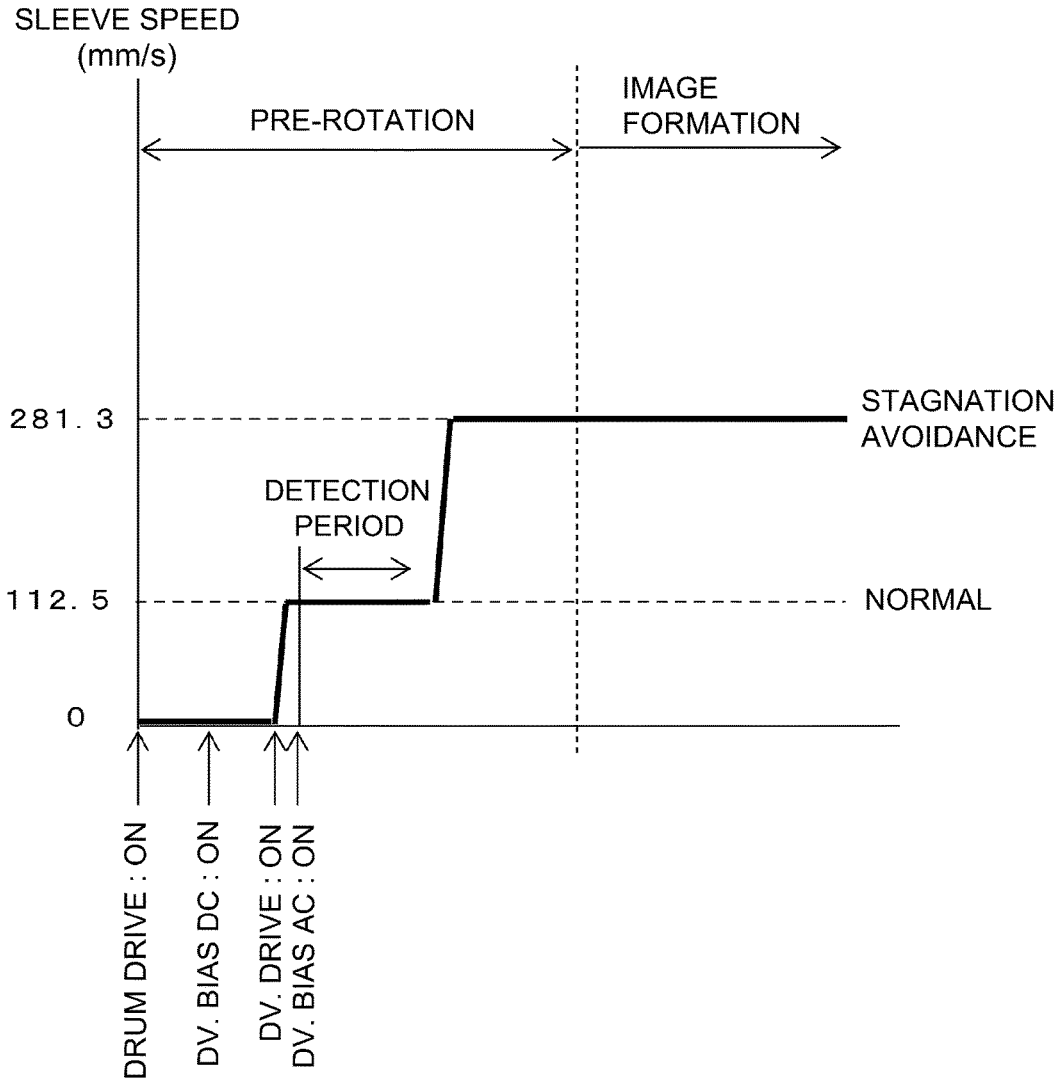
FIG. 9 is a time chart for illustrating rotation control of the developing sleeve during a low-speed mode.

In the case of this embodiment, the controller 20 receives not only a print signal but also a paper kind of a print sheet. The controller 20 operates the developing device 4 during the pre-rotation under the developing condition during the normal state (S1-S4), but in the case where the paper kind of the print sheet is "thick paper", the controller 20 rotates the photosensitive drum 1 and the developing sleeve 42 at 75 mm/sec and 112.5 mm/sec, respectively (low-speed mode). Then, the controller 20 carries out detection of the toner content of the developer and detection of the electrostatic capacity between the developing sleeve 42 and the photosensitive drum 1, and changes the stagnation threshold on the basis of the toner content (S5-S7). As shown in FIG. 9, as the timing when the toner content and the electrostatic capacity are detected, it is desirable that the electrostatic capacity is detected in a state in which the developing sleeve 42 is driven at the same rotational speed as that during the normal state and in which the same developing bias voltage is applied ("DETECTION PERIOD" in FIG. 9). Further, the stagnation threshold is changed on the basis of a table stored in advance in the memory 21 as shown in Table 2.

TABLE 2

| TC*1 (%) | ST*2 (V) CSM*3 (V) | ST*2 (V) LSM*4 |
|---|---|---|
| 4.0 | 2.07 | 2.01 |
| 5.0 | 2.01 | 1.95 |
| 6.0 | 1.95 | 1.89 |
| 7.0 | 1.90 | 1.84 |
| 8.0 | 1.85 | 1.79 |
| 9.0 | 1.80 | 1.74 |
| 10.0 | 1.76 | 1.70 |
| 11.0 | 1.72 | 1.66 |
| 12.0 | 1.69 | 1.63 |

*1"TC" is the toner content.
*2"ST" is the stagnation threshold.
*3"CSM" is the constant-speed mode.
*4"LSM" is the low-speed mode.

In the table shown in Table 2, the stagnation thresholds are associated with the toner contents separately in the constant-speed mode and the low-speed mode. As can be understood from Table 2, the stagnation thresholds are smaller in the low-speed mode than in the constant-speed mode. This is because the developer feeding amount decreases with a slower rotational speed of the developing sleeve 42, whereas the force for attracting the carrier 4C to the photosensitive drum 1 by application of the developing bias voltage is unchanged, with the result that by decreasing the stagnation threshold in the low-speed mode relative to the constant-speed mode, even in the low-speed mode, whether or not the SD gap is in the state in which the developer is liable to stagnate can be discriminated.

The controller 20 discriminates whether or not the electrostatic capacity is not less than the stagnation threshold (S8). In the case where the controller 20 discriminated that the electrostatic capacity is smaller than the stagnation threshold (NO of S8), the controller 20 starts image formation while maintaining the developing condition during the normal state (S10). On the other hand, in the case where the controller 20 discriminated that the electrostatic capacity is not less than the stagnation threshold (YES of S8), the controller 20 changes the DC (S9) and starts image formation in the developing condition during the normal state (S10). Specifically, the controller 20 prolongs the time of the pre-rotation and controls the motor 60 and thus increases the rotational speed of the developing sleeve 42 so as to be faster than the rotational speed, during the normal state (before the change of the developing condition), stored in the memory 21 in advance. For example, as shown as "STAGNATION AVOIDANCE" in FIG. 8, the controller 20 changes the rotational speed to a rotational speed (281.3 mm/sec, photosensitive drum peripheral speed ratio=375%) which is 2.5 times the rotational speed during the normal state. As described above, when a peripheral speed ratio to the photosensitive drum 1 increases, the amount of the developer passing through the SD gap increases, so that the stagnation of the developer does not readily generate.

As described above, even in the case where a plurality of image forming modes different in rotational speed of the developing sleeve 42 are executable, by changing the rotational speeds in the constant speed mode and the low-speed mode, an effect similar to that in the above-described First Embodiment can be obtained. That is, it is possible to compatibly realize the suppression of the image defect due to the SD gap and the developer feeding amount and the suppression of the image defect due to the stagnation of the developer.

Third Embodiment

As described above, in the First and Second Embodiments, the electrostatic capacity is detected during the pre-rotation, and on the basis of the detected electrostatic capacity, the rotational speed of the developing sleeve 42 is changed as the developing condition. In this case, when a continuous image forming job is carried out on the basis of a print signal for continuously forming images on a large number of recording materials, it takes much time until image formation on the large number of rollers is ended, so that the electrostatic capacity cannot be detected in the period. However, also during the continuous image formation on the large number of recording materials, due to some reason, the stagnation of the developer can generate with an increase in developer feeding amount. Nevertheless, unless the rotational speed of the developing sleeve 42 is changed on the basis of the electrostatic capacity during the image formation, the image defect due to the stagnation of the developer is liable to generate. Therefore, in the Third Embodiment, the electrostatic capacity is detected every predetermined number during a continuous image forming job, and on the basis of the detected electrostatic capacity, the rotational speed of the developing sleeve 42 was constituted so as to be changeable.

Figure 10:
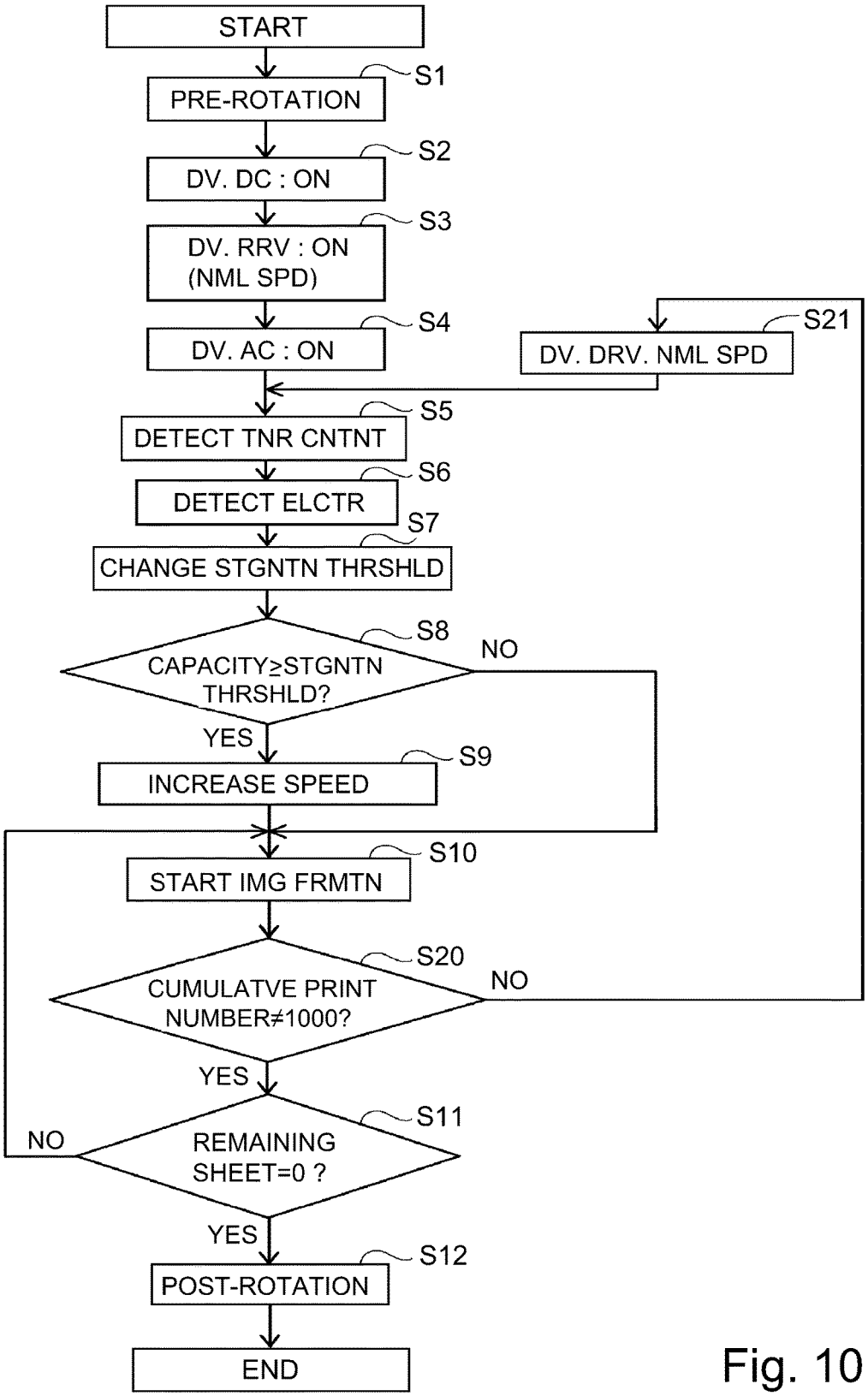
FIG. 10 is a flowchart of an image forming process in a Second Embodiment.

The Third Embodiment will be described using FIG. 10. FIG. 10 shows a flowchart of an image forming process (operation in an image forming mode) in this embodiment. When the flowchart shown in FIG. 10 is compared with the flowchart shown in FIG. 7, a difference is that processes of S20 and S21 are added, and other processes of S1 to S12 are the same.

As shown in FIG. 10, the controller 20 operates the developing device 4 under the developing condition during the normal state (S1-S4). Then, the controller 20 carries out detection of the toner content of the developer and detection of the electrostatic capacity between the developing sleeve 42 and the photosensitive drum 1, and changes the stagnation threshold on the basis of the toner content (S5-S7).

The controller 20 discriminates whether or not the electrostatic capacity is not less than the stagnation threshold (S8). In the case where the controller 20 discriminated that the electrostatic capacity is smaller than the stagnation threshold (NO of S8), the controller 20 starts image formation while maintaining the developing condition during the normal state (S10). On the other hand, in the case where the controller 20 discriminated that the electrostatic capacity is not less than the stagnation threshold (YES of S8), the controller 20 changes the DC (S9). First, the controller 20 executes the processes of S1 to S9 and thereafter starts the image formation (S10). The controller 20 starts counting of a cumulative print number in synchronism with the start of the image formation.

The controller 20 discriminates whether or not the cumulative print number reaches a predetermined number (e.g., 1000 sheets) (S20). In the case where the controller 20 discriminated that the cumulative print number does not reach the predetermined number (YES of S20), the controller 20 discriminates whether or not the remaining print number is 0 (S11). In the case where the remaining print number is not 0 (NO of S11), the controller 20 subsequently effects the image formation (S10), and in the case where the remaining print number is 0 (YES of S11), the controller executes the post-rotation control (S12), and ends the image forming process.

On the other hand, in the case where the controller 20 discriminated that the cumulative print number reached the predetermined number, i.e., every time when the cumulative print number reaches the predetermined number (NO of S20), the controller 20 returns the rotational speed of the developing sleeve 42 to that during the normal state (S21). Then, the controller 20 temporarily enlarges a sheet interval, and carries out the detection of the toner content and the detection of the electrostatic capacity in the sheet interval (S5, S6). That is, before the controller 20 causes the electrostatic capacity detecting circuit 30 to detect the electrostatic capacity, the controller 20 returns the developing condition to that before the change of the developing condition and operates the developing device. In this embodiment, the rotational speed of the developing sleeve 42 is returned to the rotational speed during the normal state. Thus, the developing device 4 is operated under the developing condition during the normal state. Then, in the case where the controller 20 discriminated that the detected electrostatic capacity is not less than the stagnation threshold (YES of S8), the controller 20 changes the developing condition (S9). Thus, in the case where the detected electrostatic capacity is not less than the stagnation threshold, the rotational speed of the developing sleeve 42 is made fast (450 mm/sec), and the image formation is resumed (S10). On the other hand, in the case where the detected electrostatic capacity is smaller than the stagnation threshold, the rotational speed of the developing sleeve 42 is kept at the rotational speed during the normal state (225/sec), and the image formation is resumed (S10).

As described above, in the case of this embodiment, in the sheet interval, not in the pre-rotation, the detection of the toner content and the electrostatic capacity was carried out, so that the rotational speed of the developing sleeve 42 was made changeable. As a result, even during the continuous image forming job, an effect similar to that in the above-described First Embodiment. That is, the suppression of the image defect due to the SD gap and the developer feeding amount and the suppression of the image defect due to the developer stagnation can be realized compatibly.

Incidentally, in the case of the Third Embodiment described above, a constitution in which the detection of the toner content and the electrostatic capacity is carried out every time when the cumulative print number reaches the predetermined number and then whether or not the detected electrostatic capacity is not less than the stagnation threshold is discriminated is employed, but the present invention is not limited thereto (S20 and S5 to S8 in FIG. 10). For example, a constitution in which the toner content and the electrostatic capacity are detected every one sheet printing and then whether or not the detected electrostatic capacity is not less than the stagnation threshold is made discriminatable may also be employed. In this case, at the time when the controller 20 discriminated that the electrostatic capacity is not less than the stagnation threshold, the rotational speed of the developing sleeve 42 is switched and the image formation is resumed. Further, in the case where the developing condition has already been changed, the detection of the toner content and the electrostatic capacity may be not detected every one sheet printing. When such control is effected, whether or not the SD gap is in the state in which the developer is liable to stagnate can be monitored at any time, so that the suppression of the image defect due to the SD gap and the developer feeding amount and the suppression of the image defect due to the developer stagnation can be compatibly realized with high reliability.

OTHER EMBODIMENTS

In the above-described embodiments, the case where the rotational speed of the developing sleeve 42 is changed as the developing condition changed on the basis of the electrostatic capacity was described. In this case, in the case where the electrostatic capacity is a predetermined amount, the rotational speed of the developing sleeve 42 is capable of being set at a value faster in the case where the toner content is a second density (toner content) higher than a first density than in the case where the toner content is the first density. However, the changeable developing condition is not limited to the rotational speed of the developing sleeve 42. For example, as the developing condition, the controller 20 can change Vback. In this case, when the electrostatic capacity is not less than the stagnation threshold (e.g., S8 in FIG. 7), the controller 20 makes Vback smaller than the potential difference (e.g., 140 V) during the normal state. Specifically, the controller 20 controls the developing voltage source 70 so that an absolute value of the DC component of the developing bias voltage is large.

Alternatively, as the developing condition, the controller 20 may also change an amplitude of the AC component of the developing bias voltage. In this case, when the electrostatic capacity is not less than the stagnation threshold, the controller 20 controls the developing voltage source 70 so that the amplitude of the AC component of the developing bias voltage is made smaller than that during the normal state.

Incidentally, values of the toner contents and the stagnation thresholds shown in Tables 1 and 2 are not limited to these values, but may also be set at optimum values depending on a constitution of the developing device 4, the kind of the developer, and the like.

In the above-described embodiments, the image forming apparatus 100 of the intermediary transfer type in which the toner images are primary-transferred from the photosensitive drums 1Y to 1K onto the intermediary transfer belt 5 and then the composite color toner images are secondary-transferred collectively onto the recording material S was described, but the present invention is not limited thereto. For example, an image forming apparatus of a direct transfer type in which the toner images are directly transferred from the photosensitive drums 1Y to 1K onto the recording material S carried and fed by a transfer material feeding belt may also be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-060907 filed on Mar. 24, 2016, which is hereby incorporated by reference herein in its entirety.

What is claimed is:

1. An image forming apparatus comprising:

a rotatable image bearing member;

a developing device including a developing container accommodating a developer containing toner and a carrier and a rotatable developer carrying member configured to carry the developer toward a position where an electrostatic image formed on said image bearing member is developed, said developing device being configured to develop the electrostatic image formed on said image bearing member with the developer;

an electrostatic capacity detecting portion configured to detect information on electrostatic capacity between said developer carrying member and said image bearing member;

a toner content detecting portion configured to detect information on a toner content of the developer accommodated in said developing device;

a driving device configured to rotationally drive said developer carrying member; and a controller configured to control said driving device, wherein on the basis of the electrostatic capacity detected by said electrostatic capacity detecting portion and the toner content detected by said toner content detecting portion, said controller controls a driving speed at which said developer carrying member is rotationally driven by said driving device.

2. An image forming apparatus according to claim 1, wherein the toner content detected by said toner content detecting portion includes a first content and a second content larger than the first content, and said controller controls said driving device so that the driving speed, when the electrostatic capacity detected by said electrostatic capacity detecting portion is a predetermined electrostatic capacity and the toner content detected by said toner content detecting portion is the second content, is larger than the driving speed when the electrostatic capacity detected by said electrostatic capacity detecting portion is the predetermined electrostatic capacity and the toner content detected by said toner content detecting portion is the first content.

3. An image forming apparatus according to claim 1, wherein the electrostatic capacity detected by said electrostatic capacity detecting portion includes a first capacity and a second capacity larger than the first capacity, and said controller controls said driving device so that the driving speed, when the toner content detected by said toner content detecting portion is a predetermined content and the electrostatic capacity detected by said electrostatic capacity detecting portion is the second capacity, is larger than the driving speed when the toner content detected by said toner content detecting portion is the predetermined content and the electrostatic capacity detected by said electrostatic capacity detecting portion is the first capacity.

4. An image forming apparatus according to claim 1, wherein at a closest position between said developer carrying member and said image bearing member, said developer carrying member moves in a direction opposite to a movement direction of said image bearing member.

5. An image forming apparatus comprising:

a rotatable image bearing member;

a developing device including a developing container accommodating a developer containing toner and a carrier and a rotatable developer carrying member configured to carry the developer toward a position where an electrostatic image formed on said image bearing member is developed, said developing device being configured to develop the electrostatic image formed on said image bearing member with the developer;

an electrostatic capacity detecting portion configured to detect information on electrostatic capacity between said developer carrying member and said image bearing member;

a toner content detecting portion configured to detect information on a toner content of the developer accommodated in said developing device;

a developing bias applying portion configured to apply, to said developer carrying member, developing biases containing a direct current bias and an alternating current bias in a superimposing manner; and a controller configured to control said developing bias applying portion, wherein on the basis of the electrostatic capacity detected by said electrostatic capacity detecting portion and the toner content detected by said toner content detecting portion, said controller controls an absolute value of a potential difference between a surface potential of said image bearing member at a non-image portion of said image bearing member and the direct current bias of the developing biases applied to said developer carrying member by said developing bias applying portion.

6. An image forming apparatus according to claim 5, wherein the toner content detected by said toner content detecting portion includes a first content and a second content larger than the first content, and said controller controls said developing bias applying portion so that the absolute value of the potential difference, when the electrostatic capacity detected by said electrostatic capacity detecting portion is a predetermined electrostatic capacity and the toner content detected by said toner content detecting portion is the second content, is smaller than the absolute value of the potential difference when the electrostatic capacity detected by said electrostatic capacity detecting portion is the predetermined electrostatic capacity and the toner content detected by said toner content detecting portion is the first content.

7. An image forming apparatus according to claim 5, wherein the toner content detected by said toner content detecting portion includes a first content and a second content larger than the first content, and said controller controls said developing bias applying portion so that the absolute value of the potential difference, when the electrostatic capacity detected by said electrostatic capacity detecting portion is a predetermined electrostatic capacity and the toner content detected by said toner content detecting portion is the second content, is larger than the absolute value of the potential difference when the electrostatic capacity detected by said electrostatic capacity detecting portion is the predetermined electrostatic capacity and the toner content detected by said toner content detecting portion is the first content.

8. An image forming apparatus according to claim 5, wherein the electrostatic capacity detected by said electrostatic capacity detecting portion includes a first capacity and a second capacity larger than the first capacity, and said controller controls said developing bias applying portion so that the absolute value of the potential difference, when the toner content detected by said toner content detecting portion is a predetermined content and the electrostatic capacity detected by said electrostatic capacity detecting portion is the second capacity, is smaller than the absolute value of the potential difference when the toner content detected by said toner content detecting portion is the predetermined content and the electrostatic capacity detected by said electrostatic capacity detecting portion is the first capacity.

9. An image forming apparatus according to claim 8, wherein said controller controls said developing bias applying portion so that an absolute value of the direct current bias, when the toner content detected by said toner content detecting portion is a predetermined content and the electrostatic capacity detected by said electrostatic capacity detecting portion is the second capacity, is larger than an absolute value of the direct current bias when the toner content detected by said toner content detecting portion is the predetermined content and the electrostatic capacity detected by said electrostatic capacity detecting portion is the first capacity.

10. An image forming apparatus according to claim 5, wherein at a closest position between said developer carrying member and said image bearing member, said developer carrying member moves in a direction opposite to a movement direction of said image bearing member.

11. An image forming apparatus comprising:

a rotatable image bearing member;

a developing device including a developing container accommodating a developer containing toner and a carrier and a rotatable developer carrying member configured to carry the developer toward a position where an electrostatic image formed on said image bearing member is developed, said developing device being configured to develop the electrostatic image formed on said image bearing member with the developer;

an electrostatic capacity detecting portion configured to detect information on electrostatic capacity between said developer carrying member and said image bearing member;

a toner content detecting portion configured to detect information on a toner content of the developer accommodated in said developing device;

a developing bias applying portion configured to apply, to said developer carrying member, developing biases containing a direct current bias and an alternating current bias in a superimposing manner; and a controller configured to control said developing bias applying portion, wherein on the basis of the electrostatic capacity detected by said electrostatic capacity detecting portion and the toner content detected by said toner content detecting portion, said controller controls an amplitude of the alternating current bias of the developing biases applied to said developer carrying member by said developing bias applying portion.

12. An image forming apparatus according to claim 11, wherein the toner content detected by said toner content detecting portion includes a first content and a second content larger than the first content, and said controller controls said developing bias applying portion so that the amplitude of the alternating current bias, when the electrostatic capacity detected by said electrostatic capacity detecting portion is a predetermined electrostatic capacity and the toner content detected by said toner content detecting portion is the second content, is smaller than the amplitude of the alternating current bias when the electrostatic capacity detected by said electrostatic capacity detecting portion is the predetermined electrostatic capacity and the toner content detected by said toner content detecting portion is the first content.

13. An image forming apparatus according to claim 11, wherein the electrostatic capacity detected by said electrostatic capacity detecting portion includes a first capacity and a second capacity larger than the first capacity, and said controller controls said developing bias applying portion so that an amplitude of the alternating current bias, when the toner content detected by said toner content detecting portion is a predetermined content and the electrostatic capacity detected by said electrostatic capacity detecting portion is the second capacity, is smaller than the amplitude of the alternating current bias when the toner content detected by said toner content detecting portion is the predetermined content and the electrostatic capacity detected by said electrostatic capacity detecting portion is the first capacity.

14. An image forming apparatus according to claim 11, wherein at a closest position between said developer carrying member and said image bearing member, said developer carrying member moves in a direction opposite to a movement direction of said image bearing member.

* * * * *